United States Patent [19]

Hsu

[11] Patent Number: 4,935,852

[45] Date of Patent: Jun. 19, 1990

[54] DECORATIVE BULBHOLDER

[76] Inventor: Aidy Hsu, No. 9, Lane 223, Cheng-Kon Road, Sec. 3, Taipei, Taiwan

[21] Appl. No.: 330,426

[22] Filed: Mar. 30, 1989

[51] Int. Cl.[5] ..... H01R 33/00

[52] U.S. Cl. ..... 362/226; 362/382; 439/617; 313/318

[58] Field of Search ..... 362/226, 382, 391; 439/611, 616, 617; 313/315, 318

[56] References Cited

U.S. PATENT DOCUMENTS

| | | | |
|---|---|---|---|
| 2,636,069 | 4/1953 | Gilbert | 362/382 X |
| 2,884,555 | 4/1959 | Peterson | 439/617 X |
| 4,791,335 | 12/1988 | Lin | 313/318 |

*Primary Examiner*—Stephen F. Husar
*Attorney, Agent, or Firm*—Bernard R. Gans

[57] ABSTRACT

An improved decorative bulbholder includes a seat, a base and a connector for connecting with a bulb which is characterized in that a plurality of slices or a projecting surface and spaced convex portions are provided on the inside wall of the seat and several gaps are formed on the circumambience of the opened end of the seat for fixedly engaging with the relative convex ring, concaves and the body of the bulb. The lower end of the seat is elongated and provided with convex-concave flanges outside and a sleeve having an opposite configuration is provided around the lower end and has two longitudinal holes for receiving electrical wires. A connector provided with two opposed gaps, two sideward waved convex portions and two L-shaped holes is engageable with the channel of the base which has relative concave insides for sealing and thus becoming waterproof.

4 Claims, 2 Drawing Sheets

DECORATIVE BULBHOLDER

BACKGROUND OF THE INVENTION

The present invention relates to an improved decorative bulbholder, and more particularly relates to an improved bulbholder which is waterproof and stably fixed after the connection of the bulb and bulbholder.

In the prior art, the decorative bulbholder comprises a seat and a base, wherein the seat connects with a bulb by glue and then is inserted into the base for engagement. The assembly procedure of this known bulbholder includes inconvenient complex steps, such as putting the glue into the seat first, and then inserting the wires of the bulb into the relative holes of the seat. Because the glue is applied to the seat first, it is difficult to assemble or connect the bulb to the bulbholder mechanically or manually. Also, the glue often overflows from the seat of the bulbholder, because the amount of glue applied to the seat is not controllable. Moreover, the lower length of the seat is equal to the length of the bulb-wire passing through the seat-hole. The lower end will not reach the bottom of the base after the connection with the base. Therefore, the inwardly extended electrical wires are only engaged with the folded bulb wires outside the seat by their front pins. This connection is undependable when used on suspended lamps.

SUMMARY OF THE INVENTION

It is the purpose of this invention, therefore, to obviate and/or mitigate the above-mentioned drawbacks.

Accordingly, a primary objective of the present invention is to provide an improved decorative bulbholder which provides a plurality of projecting slices or surfaces on the inside face of the seat and several gaps on the opened circumambience. When the seat is in connection with the bulb, the convex ring of the bulb is fixedly engaged with the projecting slices or surface and the seat fits inside the base because of the gaps. Therefore, it is easy to connect the bulb to the bulbholder without the use of glue.

Another objective of the present invention is to provide an improved decorative bulbholder with an elongated lower portion for increasing the friction between the seat and the base. This provides an improved engagement between the bulb and the electrical wires and assures an electric combination between the pins and the bulb-wires.

A further objective of the present invention is to provide an improved decorative bulbholder which provides a connector under the base. Both sides of the connector are provided with a hole for the relative electrical-wire penetrating and connecting with another bulb. The connector is also provided with curved flanges for engaging with the concaves of the base.

A still further objective of the present invention is to provide an improved decorative bulbholder which provides a channel on the bottom of the seat and a hole on the respective bottom of the base. Thus, the bulb can be easily replaced by separating the seat from the base and then taking off the bulb.

Still another objective of the present invention is to provide an improved decorative bulbholder which provides an engaged surface inside the lower portion of the seat for engaging with a plastic sleeve which makes the bulbholder waterproof.

Further objectives and advantages of the present invention will become apparent as the following description proceeds, and the features of novelty which characterize the invention will be pointed out with particularity in the claims.

DETAILED DESCRIPTION OF THE PREFERRED EMBODIMENT

Figure 1:
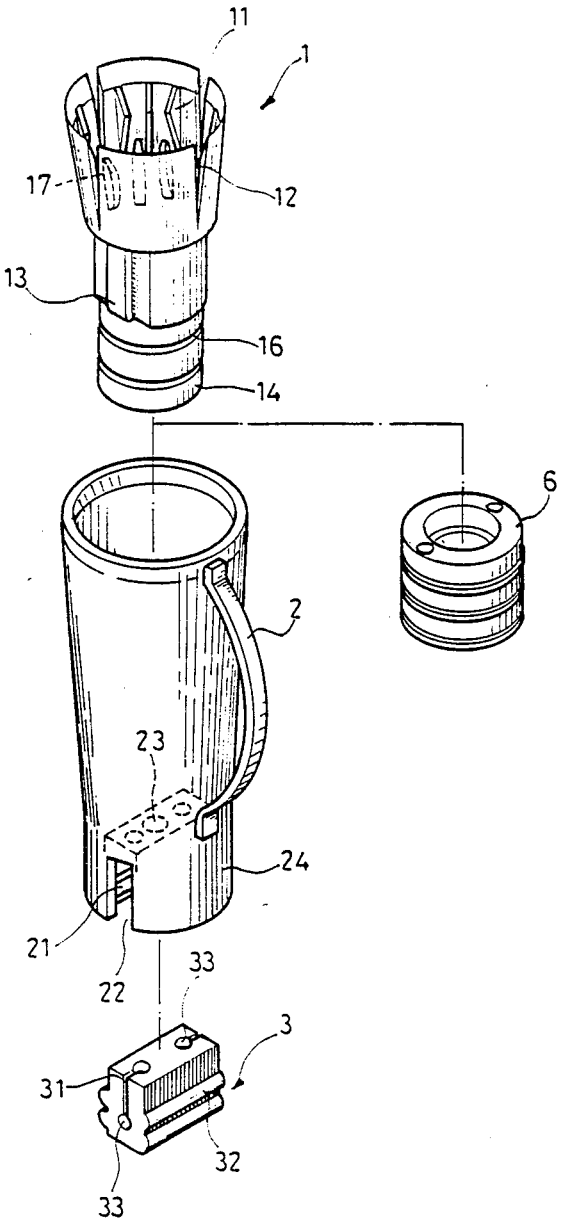
FIG. 1 is an exploded perspective view of an improved decorative bulbholder in accordance with the present invention.

With reference to the drawings and in particular to FIG. 1 thereof, it can be seen that an improved decorative bulbholder in accordance with the present invention comprises a seat (1), a base (2) and a connector (3). The seat (1) has an opened upper end for connecting with a bulb (4) and an elongated lower end (14) provided with a plurality of circular engaged flanges (16) for engaging with a sleeve (6). The seat (1) accompanied with the bulb (4) can then be inserted into the base (2) and a connector (3) is inserted into a bottom portion (24) of the base (2) while a plurality of wires (5) are extended outwards from both sides of the connector (3). The bulbholder is thus assembled.

Figure 2:
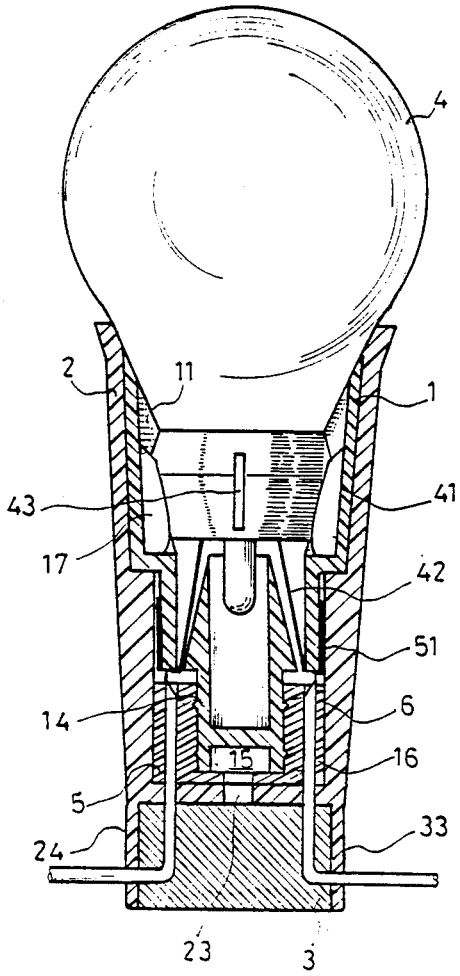
FIG. 2 is a plan cross-sectional view after connecting with a bulb and electrical-wires of FIG. 1.

Now referring to both FIGS. 1 and 2, there are a plurality of projecting slices (11) provided on the inside wall of the seat (1) and a plurality of gaps (12) on the circumambience of the seat (1). The seat is constructed of a flexible plastic material and is provided with gaps (12). Therefore, the seat (1) can engage with the bulb (4) easily. During this assembly, the convex ring (41) of the bulb (4) will be hooked under the projecting slices (11) and a plurality of concave portions (43) formed on the lower end of the bulb (4) are engaged with a plurality of convex portions (17) formed on the inside wall of the seat (1). After this simple procedure, the bulb (4) is capable of connecting with the seat (1) fixedly and which prevents the bulb from separating from the seat (1) or rotating within the seat (1).

A plurality of bulb wires (42) of the bulb (4) pass through a plurality of the holes (13) of the seat (1) and are folded sideways. The lower end (14) of the seat (1) is elongated. As the seat (1) accompanied with the bulb (4) is inserted into the base (2), the bulb wires (42) of the bulb (4) are just contacted with a plurality of pins (51) corresponding to a plurality of electrical-wires (5) which provide an electrical connection. The elongated lower end (14) of the seat (1) maintains the electrical-wires (5) between the seat (1) and the base (2). Moreover, the elongated lower end (14) engages with the sleeve (6). The sleeve (6) has two longitude holes therein (1) for a better connection by receiving the electrical-wires (5) in the said holes.

The connector (3) has two opposided gaps (31) and two waved convexs (32) on both sides. The connector (3) can be connected with a first channel (22) having a plurality of relative waved concaves (21) of the base (2). Two L-shaped holes (33) of the connector (3) are provided for receiving the electrical-wires (5). The electrical wires (5) have their free ends extended outwards for the connection between light sets. The combination of this structure in accordance with the present invention is thus absolutely waterproof.

In addition, a second channel (15) is provided on the lower end (14) of the seat (1) and a hole (23) is provided on the base (2) in a relative position. When the bulb (4) is damaged it can be easily replaced by taking off the connector (3), inserting a suitable tool, such as a screwdriver, into the hole (23), and pushing at the second channel (15), thereby separating the seat (1) from the base (2). This method of replacement will prevent damage to the seat (1) which resulted from pulling the bulb (4) directly out from the seat (1) as was necessary in the prior art.

While the invention has been explained in relation to its preferred embodiment, it is to be understood that various modifications thereof will become apparent to those skilled in the art upon reading this specification. Therefore, it is to be understood that the invention disclosed herein is intended to cover such modifications as fall within the scope of the appended claims.

I claim:

1. An improved bulbholder for a bulb having a convex ring, a concave portion, and a body comprising:

a base;

a seat engageable with said base, said seat having an inside wall, an open upper end, and an elongated enclosed lower end, said open end having a plurality of projecting surfaces and a plurality of spaced convex portions formed on the inside wall of the seat, said open upper end further having a plurality of gaps formed on the circumambience of said open upper end for fixedly engaging with the convex ring, the concave portion, and the body of the bulb;

a sleeve surrounding said lower end of said seat, said sleeve having two longitudinal holes formed within; and a connector engageable with said base; and said connector having two gaps in opposite sides of said connector, two waved convex portions, and two L-shaped holes formed within said two gaps.

2. An improved bulbholder as set forth in claim 1, wherein said enclosed lower end of said seat further comprises a second channel, and said base further comprises a hole in a position corresponding to the position of said second channel.

3. An improved bulbholder as set forth in claim 1, wherein said L-shaped holes of said connector are waterproof when said connector is engaged with said base.

4. An improved bulbholder as set forth in claim 1, wherein said enclosed lower end further comprises a plurality of convex-concave flanges, and said sleeve further comprises a plurality of configurations for engaging with said flanges of said enclosed lower end.

* * * * *